US005146889A

United States Patent [19]

Swanson et al.

[11] Patent Number: 5,146,889

[45] Date of Patent: Sep. 15, 1992

[54] GOVERNOR ASSIST MECHANISM

[75] Inventors: Steven M. Swanson, Minneapolis; John C. Fanner, Coon Rapids; Nick V. Halstead, Oak Grove, both of Minn.

[73] Assignee: Onan Corporation, Minneapolis, Minn.

[21] Appl. No.: 584,265

[22] Filed: Sep. 18, 1990

Related U.S. Application Data

[62] Division of Ser. No. 341,644, Apr. 21, 1989, Pat. No. 5,003,949.

[51] Int. Cl.[5] ..... F02D 31/00; F02M 39/00

[52] U.S. Cl. ..... 123/376; 123/403; 123/382

[58] Field of Search ..... 123/337, 376, 402, 403, 123/382, 383

[56] References Cited

U.S. PATENT DOCUMENTS

| | | | |
|---|---|---|---|
| 2,330,494 | 7/1945 | Ball | 200/59 |
| 2,366,254 | 1/1945 | Paton | 74/472 |
| 2,533,180 | 12/1950 | Rhodes | 123/376 |
| 3,659,499 | 5/1972 | Woodward | 91/454 |
| 4,073,272 | 2/1978 | Burgess | 123/103 B |
| 4,103,652 | 12/1978 | Garside et al. | 123/103 R |
| 4,117,809 | 10/1978 | Kittler | 123/403 |
| 4,117,904 | 10/1978 | Matsubara | 180/108 |
| 4,137,876 | 2/1979 | Volpe | 123/103 R |
| 4,248,193 | 2/1981 | Choma et al. | 123/341 |
| 4,274,377 | 6/1981 | Kraw, Jr. | 123/396 |
| 4,282,838 | 8/1981 | Davidson et al. | 123/198 |
| 4,337,743 | 7/1982 | Mattson | 123/396 |
| 4,355,610 | 10/1982 | Parks et al. | 123/386 |
| 4,380,418 | 4/1983 | Crawford et al. | 417/87 |
| 4,391,245 | 7/1983 | Larson | 123/339 |
| 4,517,942 | 5/1985 | Pirkey | 123/376 |
| 4,531,489 | 7/1985 | Sturdy | 123/376 |
| 4,543,932 | 10/1985 | Sturdy | 123/376 |
| 4,660,521 | 4/1987 | Higuchi | 123/376 |
| 4,836,167 | 6/1989 | Huffman | 123/403 |

FOREIGN PATENT DOCUMENTS

| | | | |
|---|---|---|---|
| 0853138 | 8/1981 | U.S.S.R. | 123/376 |

*Primary Examiner*—Carl S. Miller

*Attorney, Agent, or Firm*—Merchant, Gould, Smith, Edell, Welter & Schmidt

[57] ABSTRACT

An apparatus for assisting a primary governor device (20) on an engine at certain load conditions or during transient loading is disclosed. The primary governor device has a control arm (12) which is moved by a primary governor spring (15) via a primary governor arm (14). The control arm (12) governs opening and closing of the throttle plate (10) on the carburetor (11). Four embodiments (47, 54, 30 and 78) of the governor assist mechanism are disclosed. The governor assist apparatus has an assist spring (48, 55, 32, 76) operatively connected to the control arm (12). A vacuum capsule (41) actuates the assist spring (48, 55, 32, 76) from the primary governor device (20) according to the vacuum in the intake manifold and load on the engine. The first embodiment or linear mechanism (47) has an assist spring (48), an intermediate link (49), and the diaphragm plunger (40) in linear alignment. The second embodiment or rocker mechanisn (54) interconnects the assist spring (55) and the diaphragm plunger (40) by means of a pivotal arrangement or bell crank (58). The third embodiment or hinge mechanism (30) has an intermediate link (36) which abuts against a clip (49) on the control arm (12). The fourth embodiment or governor retarding mechanism (78) has the assist spring (76) positioned directly between the primary governor arm (14) and vacuum capsule (41).

11 Claims, 5 Drawing Sheets

FIG. 3
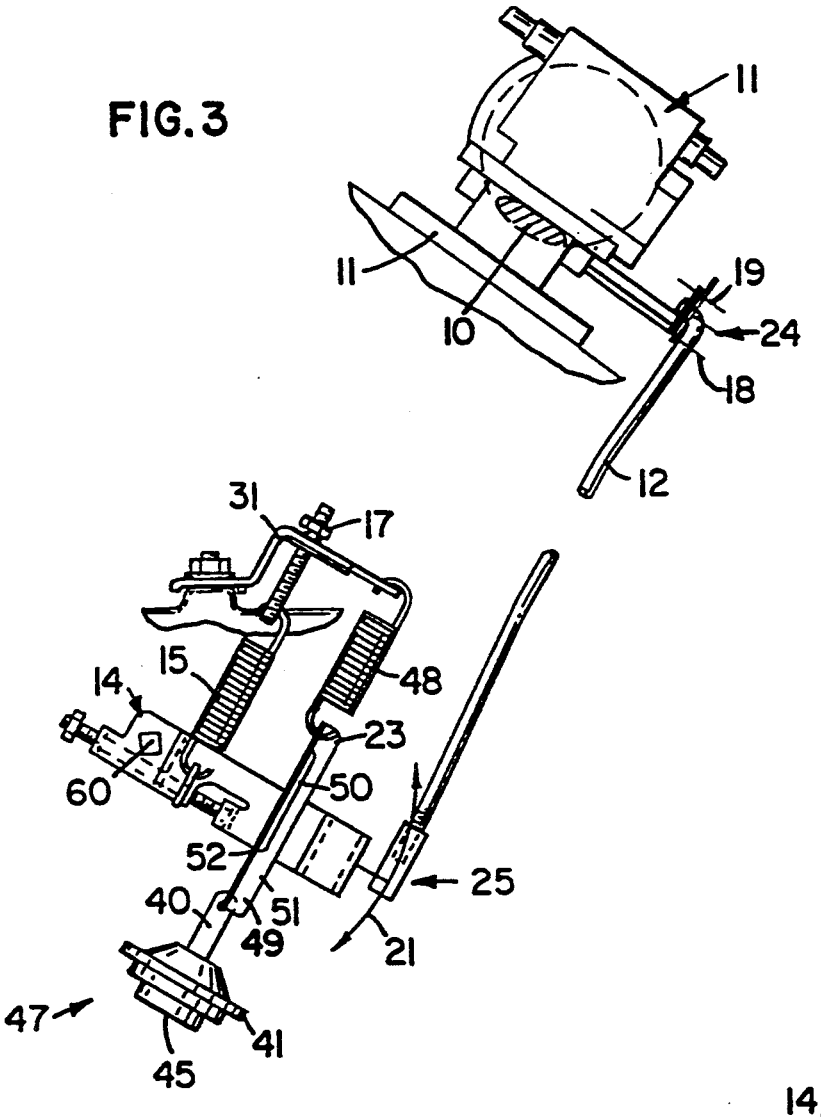
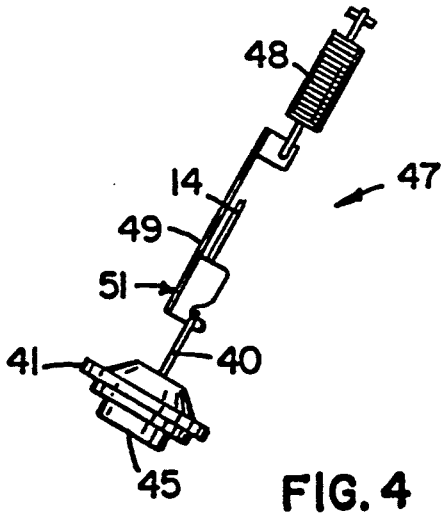
FIG. 4

FIG. 7
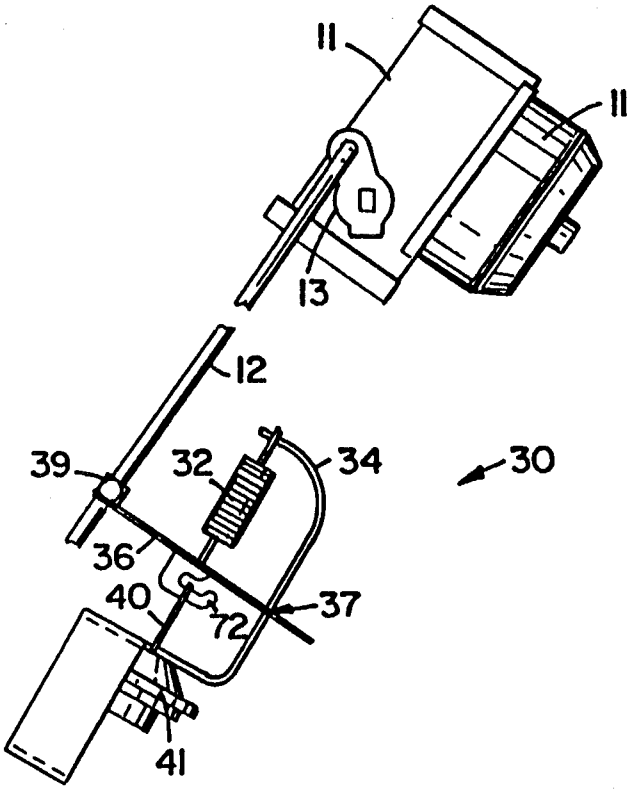
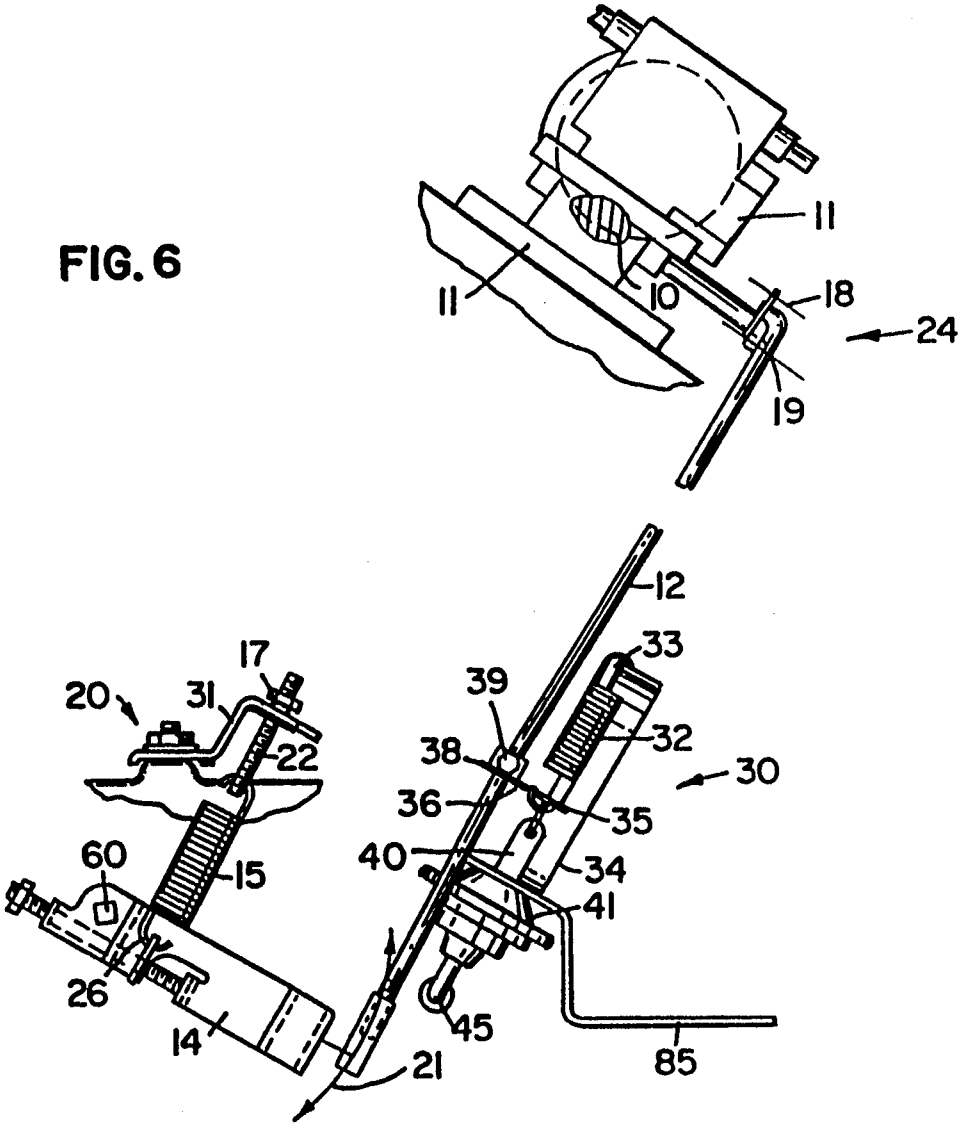
FIG. 6

GOVERNOR ASSIST MECHANISM

This is a division of application Ser. No. 341,644, filed Apr. 21, 1989, now U.S. Pat. No. 5,003,949.

FIELD OF THE INVENTION

The present invention relates generally to internal combustion engines, and more particularly to a mechanism to increase or control the speed setting of a governor during operation of an engine when load is applied.

BACKGROUND OF THE INVENTION

A governor is a device for regulating the speed of a prime mover while it is subject to loading. The governor keeps the prime mover speed at or near the desired revolutions per minute by varying the flow of energy to or from it. The governor allows the speed of the prime mover to remain essentially constant regardless of load and other disturbances, or causes the prime mover's speed to change in accordance with operating conditions like the speed setting. When the prime mover drives a generator supplying electrical power at a given frequency, a governor must be used to hold the prime mover at a speed that will yield this frequency. The desired speed is theoretically maintained by the governor regardless of the load or other disturbances.

However, one difficulty with conventional governor systems is that they are often unable to maintain the desired engine speed when the engine is subjected to relatively high loads. Beyond a certain point, the output falls gradually as the load is increased. This phenomenon occurs due to mechanical losses and other limitations of the engine. Thus, at high loads the engine speed drops off to a point lower than the desired speed, which is referred to as the "governor droop."

Another difficulty with governed engines and generators is that when a load is rapidly applied or removed, the system goes into resonance or "ringing" and begins to hunt. When engine hunting occurs, the engine runs faster or slower than the desired speed in an attempt to match the load on the engine instead of running at a steady or constant speed. In an attempt to reach the proper setting, the governor pushes backward and forward quickly, but tends to overshoot the desired speed setting. When hunting occurs in an engine, the effect is annoying and disconcerting to the user. When hunting occurs in a generator, the frequency and voltage of the output varies, for example, causing the lights to dim and brighten. In addition, hunting can cause damage to sensitive electronic equipment. For these reasons, it is desirable for the power output of the engine and generator to remain constant.

Another concern for general applications, e.g., garden tractors, is that the engine idle (no load) speed must be set higher than the required high load speed due to the conventional governor's droop characteristic at high loads. This high idle speed results in obtrusive noise levels and unnecessary engine wear.

The present invention solves these and many other problems associated with currently available governor systems.

SUMMARY OF THE INVENTION

The present invention comprises an apparatus for assisting a primary governor device on an engine at relatively high loads or during transient loading. The primary governor device has a throttle control arm which is moved by a primary governor spring via a primary governor arm. The control arm governs opening and closing of the throttle plate on the carburetor. The governor assist apparatus comprises an assist spring which causes movement of the control arm. The governor assist apparatus also includes linkage means for interconnecting the assist spring to the primary governor device. There is also a means for actuating the assist spring with respect to the primary governor device when the load on the engine has reached a predetermined point. The actuation means includes a vacuum capsule, one chamber of the vacuum capsule being in fluid communication and at the same vacuum pressure as the intake manifold. A diaphragm plunger is interconnected to the diaphragm and the governor boost mechanism so as to disengage the governor boost mechanism when appropriate.

The governor boost mechanism of the present invention acts in parallel with the primary governor system to assist the primary governor system as needed. The governor control mechanism is adjustable so as to begin assisting the primary governor system at a particular load level.

Four embodiments of the governor assist mechanism are disclosed. The first embodiment or linear mechanism has an assist spring, an intermediate link, and the diaphragm plunger in linear alignment. The second embodiment or rocker mechanism interconnects the assist spring and the diaphragm plunger by means of a pivotal arrangement or bell crank. The third embodiment or hinge mechanism has an intermediate link which abuts against a clip on the control arm. These first three embodiments-serve to "boost" the action of the governor and open the throttle at relatively high loads. The fourth embodiment or governor retarding mechanism serves to assist the primary governor arm in the opposite direction, i.e., to close the throttle at relatively low loads. The fourth embodiment's assist spring is positioned directly between the diaphragm plunger and primary governor arm.

A particular advantage of the present invention is that the governor assist mechanism enables the engine to maintain a given speed over an extended range. The additional force from the governor boost mechanism changes the engine's governing characteristics to increase the engine speed and load-carrying capabilities. By providing assistance to the primary governor, the normal governor droop characteristic typically experienced at high loads is substantially eliminated. Thus, the engine speed output remains constant regardless of the amount of load on the engine. In generator applications, the frequency and voltage remain constant. Consequently, the governor boost mechanism extends the power range of the prime mover. In addition, the governor boost mechanism, i.e., the first three above-described embodiments, automatically disengages to provide no assistance to the primary system at the relatively low load range, when no such assistance is necessary.

The governor assist device also allows the engine to run at a higher speed as the load is applied, relative to the speed at which it would run with the use of a conventional governor. This is in contrast to conventional governor mechanisms, where the engine speed decreases with increasing load, i.e., the "governor droop" mentioned above. Because of conventional governor droop, the idle speed must be set higher than the required engine speed under load. This device allows the idle speed to be set lower than a conventional governor system's setting, since the engine speed will not drop off with increasing load. This feature is particularly useful for consumer applications where the lower, no-load idle speed possible with this device results in lower engine noise levels and is less obtrusive. At the same time, maximum power output is still available from the engine due to increased speed at higher loads.

Another advantage of the present invention is that it decreases the engine hunting which otherwise occurs during transient load operation. The governor boost mechanism accomplishes this by acting as a damping system for governor instabilities which cause the engine speed to hunt. The governor boost mechanism results in decreased hunting because the additional spring force of the boost mechanism limits the amount of movement of the throttle plate, resulting in smaller oscillations. Accordingly, less time is necessary for the prime mover to stabilize after transient operation.

Another feature of the present invention is that it can be utilized regardless of the construction of the primary governor system. The principles of the present invention can be easily adapted to the particular construction of the primary governor system, and several exemplary configurations of the governor boost mechanism are disclosed herein.

The present invention is usable in conjunction with constant speed applications, such as for generators. In addition, the present invention can be used for "reverse regulation," i.e., to vary the speed according to the load. An example of the latter application would be a garden tractor, in which the load and speed setting varies according to the height and thickness of the grass being cut.

For a better understanding of the invention, and of the advantages attained by its use, reference should be made to the drawings and accompanying descriptive matter, in which there is illustrated and described preferred embodiments of the invention.

BRIEF DESCRIPTION OF THE DRAWINGS

In the Drawings, which form a part of the instant specification and are to be read therewith, optimum embodiments of the invention are shown, and, in the various views, like numerals are employed to indicate like parts:

FIG. 3 is a schematic view of the first, linear embodiment of the present invention;

FIG. 4 is a view of the first, linear embodiment, rotated 90° from the view shown in FIG. 3;

FIG. 6 is a schematic view of the third, hinged embodiment of the present invention;

FIG. 7 is a view of the hinged embodiment, rotated 90° from the view shown in FIG. 6;

DETAILED DESCRIPTION OF THE PREFERRED EMBODIMENTS

Figure 2:
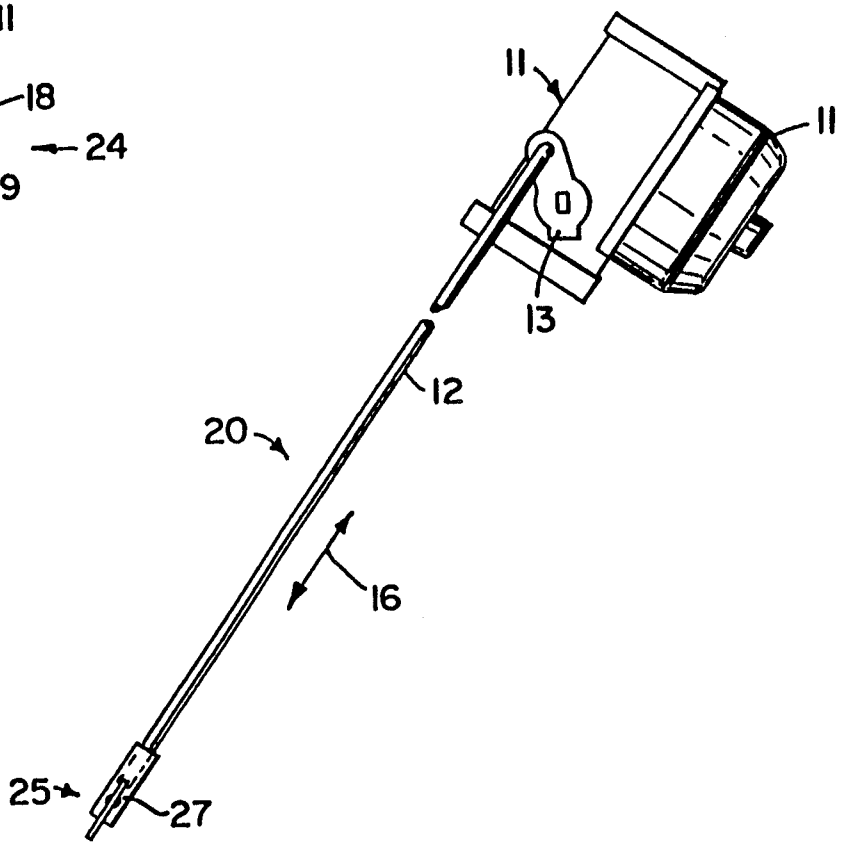
FIG. 2 PRIOR ART
FIG. 2 is a view of the conventional governor system rotated 90° from the view shown in FIG. 1.
Figure 1:
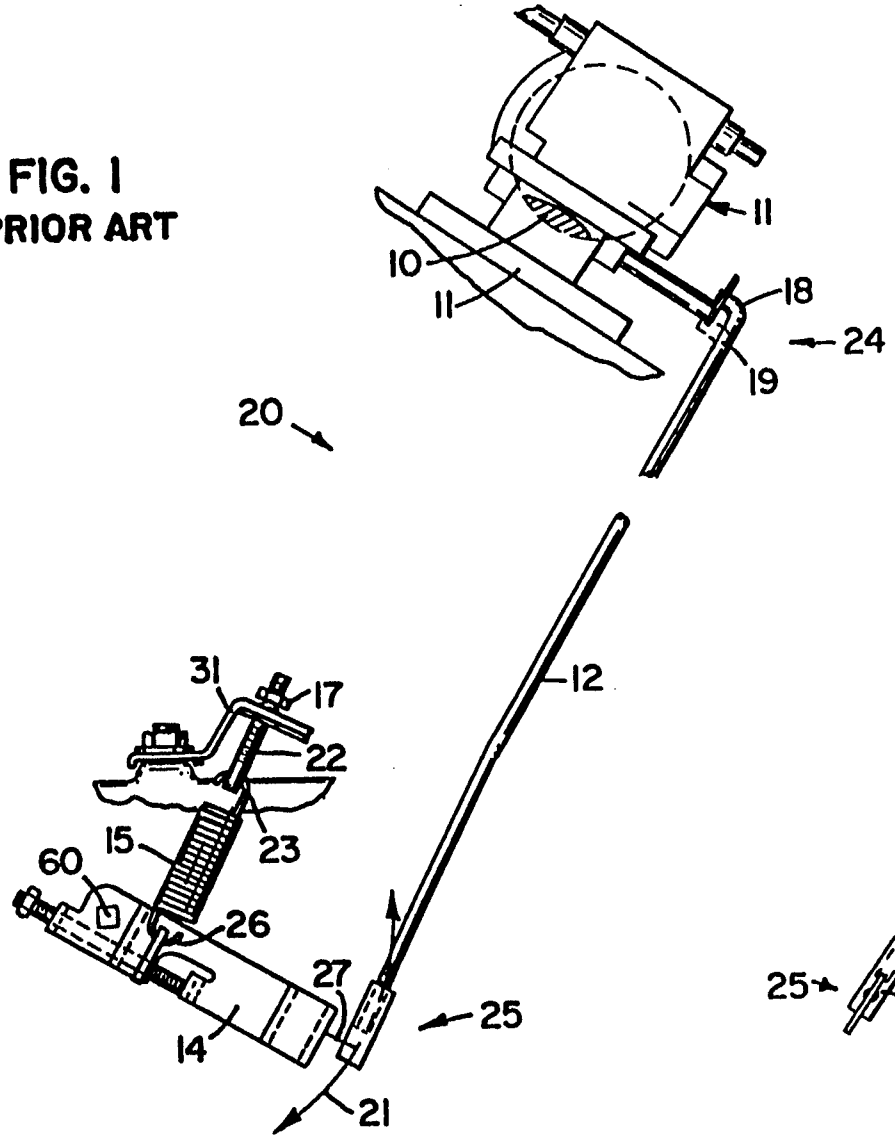
FIG. 1 PRIOR ART
FIG. 1 is a schematic view of a conventional governor system.

Referring now to the drawings, FIGS. 1 and 2 illustrate the operation of a conventional primary governor system, indicated generally at 20. A carburetor 11 is mounted on an intake manifold, and the carburetor 11 has a carburetor butterfly valve or throttle plate 10 that rotates within the carburetor throat in response to movement of a throttle control arm or throttle linkage 12. The engine receives a combustible mixture of fuel and air from the carburetor 11 in the usual and well-known manner.

The opening and closing of the throttle plate 10 is controlled by a throttle lever 13, which is interconnected to the control arm 12 so as to control opening and closing of the throttle plate 10. The control arm 12 has a first end 24 and a second end 25. As viewed in FIG. 1, the upper end 24 of the control arm 12 is illustrated in its first and second positions, the position 18 corresponding to an open throttle plate 10 and the position 19 corresponding to a closed throttle plate 10. The arrow 16 indicates the linear travel of the control arm 12. In FIG. 2, the control arm 12 is illustrated in its upper position which causes the throttle plate 10 to be open.

A primary governor spring 15 controls the position of the control arm 12 of the primary governor device 20. One end of the spring 15 is mounted to a suitable support bracket 31. In the preferred embodiment, an arm 22 interconnects the support bracket 31 and spring 15. The arm 22 and spring 15 are attached by a suitable fastener 23, such as a hook arrangement. The bracket 31 or other support means is utilized to mount the primary governor device 20 to the engine. In the preferred embodiment, the mounting bracket 31 is attached to a vertical frame wall of the engine. A stop 17 is mounted upon the arm 22, and it abuts against the support bracket 31. The longitudinal position of the stop 17 with respect to the arm 22 is adjustable according to the particular application in order to control the speed setting of the primary governor system 20.

The tension spring 15 is coupled to a primary governor arm 14 which interconnects the spring 15 with the second end 25 of the control arm 12. Movement of the primary governor spring 15 causes movement of the control arm 12 by means of the primary governor arm 14, as illustrated by the arrow 21 in FIG. 1. There is a pivot point 60 at one end of the primary governor arm 14. The primary governor arm 14 is interconnected with the governor spring 15 and control arm 12 by means of suitable fastening arrangements 26, 27 respectively.

The governor boost mechanism of the present invention acts in conjunction with the conventional or primary governor system 20 described above. It is to be understood that there are many primary governor systems 20 available, and the principles of the present invention can be applied to the construction of the various primary governor systems to allow the governor boost mechanism of the present invention to work with the various primary governor systems. The governor boost mechanism can be retrofitted to work on existing governor systems, and a variety of governor boost embodiments are described below. The primary consideration in choosing between the different embodiments of the governor boost mechanism is the particular packaging constraints and construction of the engine or generator.

The first embodiment of the governor boost mechanism is illustrated generally at 47 in FIGS. 3–4. The governor boost mechanism 47 has a secondary assist spring 48 which is generally parallel to the primary control arm 12. One end of the secondary assist spring 48 is interconnected to the mounting bracket 31 which also supports the primary governor spring 15. The opposite end of the tension spring 48 is interconnected by means of a suitable fastener to linkage means or an intermediate link 49. The linkage means 49 has a first and second end, the first end being interconnected to the assist spring 48. The intermediate link 49 preferably has a longitudinal slot 50 therein which is sized and configured to accommodate the primary governor arm 14. Thus, the primary governor arm is slidable within the slot 50.

The governor boost mechanism 47 can be adjusted to initiate activation of the governor boost system 47 when the primary governor system 20 has reached a predetermined load. This adjustment is accomplished by substituting an intermediate link 49 which has a slot 50 of an appropriate size. In the preferred embodiment, the intermediate link 49 preferably has ends 23, 51 which facilitate substitution of intermediate links 49 having different sized slots 50 when appropriate.

The governor boost mechanism of the present invention also includes disengagement means for automatically deactivating itself at relatively light engine loads which can be adequately handled by the primary governor system 20. In the preferred embodiment, this disengagement means is a vacuum pull-off system having a vacuum capsule 41.

The vacuum pull-off mechanism 41 operates on the principle that the vacuum generated in the intake manifold and carburetor 11 of an engine decreases as greater load is placed on the engine. The vacuum pull-off device 41 utilizes the vacuum in the manifold to make the governor boost system inoperative at low loads. At no load, the throttle plate 10 is closed, causing the high intake vacuum downstream. As the engine produces more power, a greater amount of air (and fuel) is required. This is acquired by opening the carburetor throttle plate 10 and results in a decrease of the intake vacuum as more air enters the engine.

Figure 8A:
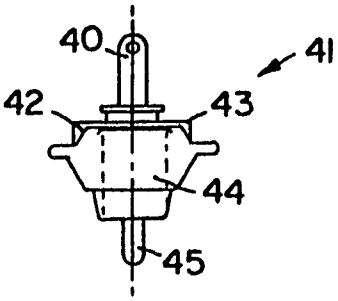
FIGS. 8*a* and 8*b* are side sectional views of the vacuum capsule utilized with the present invention.

The vacuum capsule 41 is illustrated in FIGS. 2–7 and 9 in conjunction with the various governor assist mechanism embodiments, and is also illustrated in detail in FIG. 8. As shown in FIG. 8, within the vacuum capsule 41 is a diaphragm 42, which separates the vacuum capsule 41 into two chambers 43, 44 having independent pressure values. The flexible diaphragm 42 responds to the pressure gradient between the chamber 44 and the ambient 43. One end of a diaphragm plunger 40 is interconnected to the diaphragm 42 and moves therewith. The vacuum in the chamber 44 is the same as the vacuum in the intake manifold. A conduit or vacuum line 45 is in fluid communication with the intake manifold by means of a suitable hose (not shown), thus allowing the vacuum pull-off system 41 to respond to the vacuum in the intake manifold.

Figure 8B:
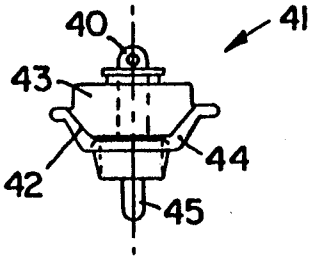

At relatively light loads, there is a high vacuum in the manifold, so that the diaphragm moves downwardly as viewed in FIG. 8*b*. As a result, the governor boost system 47 is not activated, because the mechanism 41 offsets the force of the secondary assist spring 48. Thus, at low loads, the vacuum pull-off 41 operates to disengage the governor boost mechanism 47 and to allow the primary governor system 20 to close the throttle plate 10.

However, at relatively high loads, the vacuum decreases and the pressure in the manifold becomes higher and approaches atmospheric pressure. This is the situation illustrated in FIG. 8*a*. That is, the higher pressure within the chamber 44 pushes the diaphragm 42 upwardly as viewed in FIG. 8*a*. This movement of the diaphragm causes upward movement of the diaphragm plunger 40, thereby activating the governor boost mechanism 47. In other words, at high loads there is less diaphragm force to restrict the assist spring 48. The unrestricted assist spring 48 contracts and places additional force on the primary governor device 20 to open the throttle plate 10.

In operation of the first embodiment of the governor boost mechanism 47 at high loads, the assist spring 48 compresses, thereby placing additional force on the primary governor arm 14 to cause additional movement of the control arm 12. When the control arm moves in a general upward direction as illustrated in FIGS. 3 and 4, the throttle plate 10 opens as the end 24 of the control arm 12 moves from position 19 to position 18.

The size and configuration of the slot 50 in the intermediate link 49 determines the point at which the governor assist mechanism 47 is activated. At relatively light loads, the vacuum pull-off system 41 moves the intermediate link 49 in a generally downward direction as viewed in FIGS. 3 and 4. The end 52 of the slot 50 does not abut against the primary governor arm 14 until the predetermined, relatively high load has been reached which necessitates activation of the governor boost system 47. In this manner, the end 52 is the point of engagement for the governor boost mechanism 47. When the governor boost mechanism is activated, the combination of the primary governor spring and the assist spring results in a greater movement of the control arm 12. Accordingly, the throttle plate 10 is opened a greater amount, and the engine quickly responds to the higher load.

Figure 5:
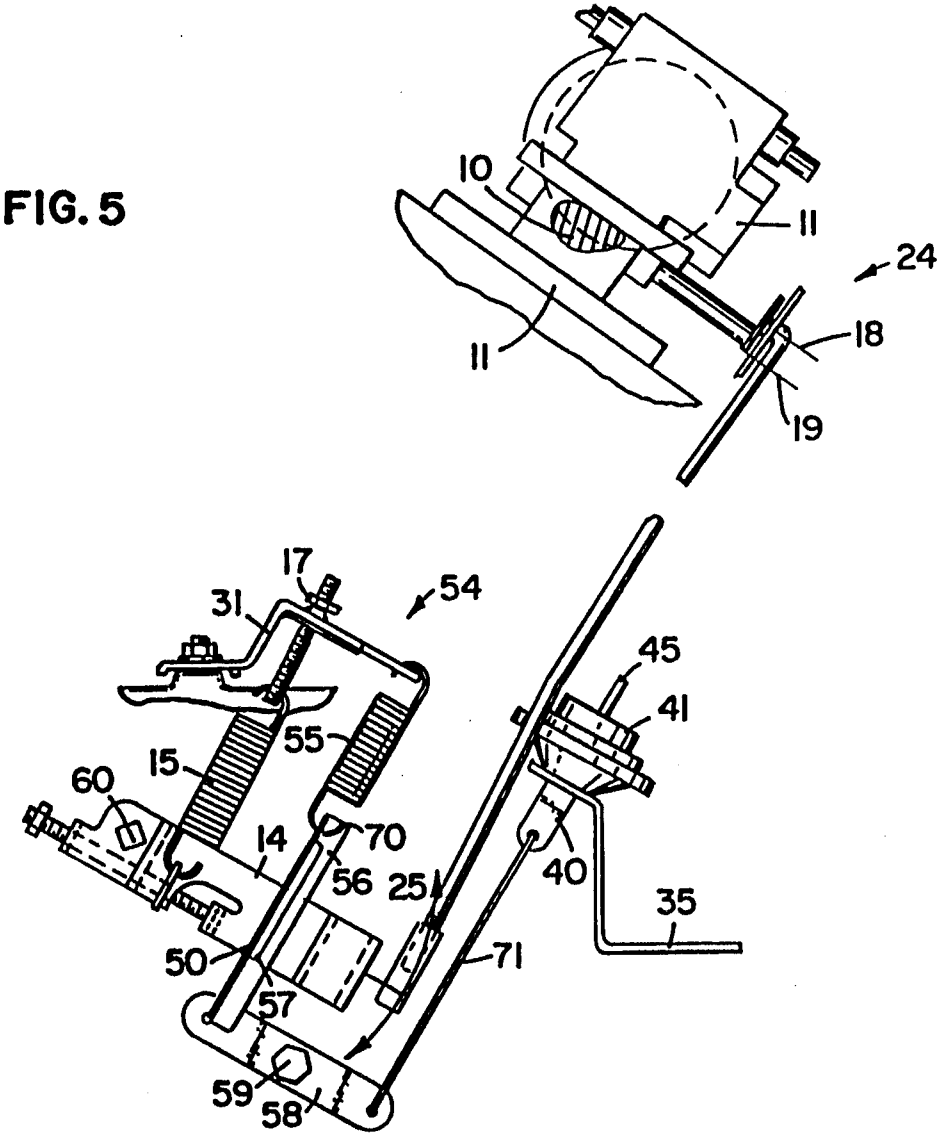
FIG. 5 is a schematic view of the second, rocker embodiment of the present invention.

The second embodiment of the governor boost mechanism is illustrated generally at 54 in FIG. 5. The second embodiment is termed the rocker governor boost mechanism. The rocker mechanism embodiment 54 has a secondary assist spring 55 in parallel with the primary governor spring 15. A first end of the tension spring 55 is interconnected to the bracket 31 which also supports the primary governor spring 15. The opposite end of the assist spring 55 is interconnected by means of a suitable fastener 70 to linkage means 56. The linkage means or intermediate link 56 has a longitudinal slot 57 therein which accommodates the primary governor arm 14. The opposite end of the intermediate link 56 is interconnected to a bell crank 58 having a central pivot point 59.

The operation of the rocker mechanism is similar to the first embodiment, except for the manner in which the vacuum pull-off device 41 is interconnected to the assist spring 55. In the first linear embodiment, the secondary assist spring 48, intermediate link 49, and vacuum pull-off plunger 40 are in linear alignment. In the second rocker embodiment, the vacuum pull-off plunger 40 and intermediate link 56 operate through a pivotal arrangement 58. In both embodiments, movement of the intermediate link causes movement of the primary governor arm 14 and therefore control of the throttle plate 10.

FIGS. 6 and 7 illustrate the third embodiment of the present invention, the hinged governor boost mechanism, illustrated generally at 30. The governor boost mechanism 30 has a secondary assist spring 32 parallel to the control arm 12. One end of the tension spring 32 is connected by a suitable fastener 33 to a support bracket 34. The opposite end of the secondary spring 32 is interconnected by a suitable fastener 35 to a pivot arm 36. The pivot arm 36 serves as linkage means to transfer the force from the assist spring 32 to the primary governor system's control arm 12. One end of the pivot arm 36 is a fulcrum point 37. In the preferred embodiment, an end of the hinge arm 36 is inserted through a slot (not shown) in the support bracket 34, thereby allowing pivotal movement with respect to the slot or fulcrum point 37.

The opposite end 38 of the hinge arm 36 has a U-shape or forked end in the preferred embodiment. The end 38 of the hinge arm 36 is sized so that the control arm 12 fits within the notch of the U-shaped end. In this manner, the control arm 12 is able to slide in its linear direction with respect to the arm 36.

Mounted upon the control arm 12 is a clip member 39. The clip 39 may be of any suitable configuration. For example, the clip may be a locking ring having an adjustment locking screw such as a ferrule, or a spring clip. The clip 39 abuts against the forked bracket 36. The clip 39 is mounted so as to be stationary with respect to the control rod 12. As with the other two embodiments, the governor boost mechanism 30 can be adjusted to initiate assistance of the primary governor system 20 at any load. This adjustment is accomplished by positioning the clip 39 at the desired longitudinal position along the control rod 12.

A mounting bracket 85 is also provided to mount the secondary governor system 30. In the preferred embodiment, the support bracket 34 and mounting bracket 85 are made of a single, integral piece. A feature of the third, hinged embodiment of the governor boost mechanism is that all of the components can be mounted together so as to be removable as a unit. That is, to install the third embodiment within the engine, the user need simply position the clip 39 and the forked bracket 36 proximate thereto and attach the mounting bracket 35 at an appropriate position.

In operation of the third embodiment, the forked end 38 of the arm 36 is below the control arm clip 39 as viewed in FIGS. 6–7 and not in contact therewith at relatively light loads. Since there is no contact between the forked arm 36 and the clip 39 in this situation, the secondary assist system 30 is not activated. However, at relatively high loads, the diaphragm arm 40 moves upwardly as viewed in FIGS. 6 and 7, thereby causing compression of the secondary assist spring 32 and upward movement of the forked bracket 36. At the desired point, the forked bracket 36 abuts the clip 39 and the upward movement (as viewed in FIGS. 6 and 7) of the diaphragm arm 40 and forked bracket 36 thereby causes upward movement of the control arm 12, thereby opening the throttle plate 10.

Figure 9:
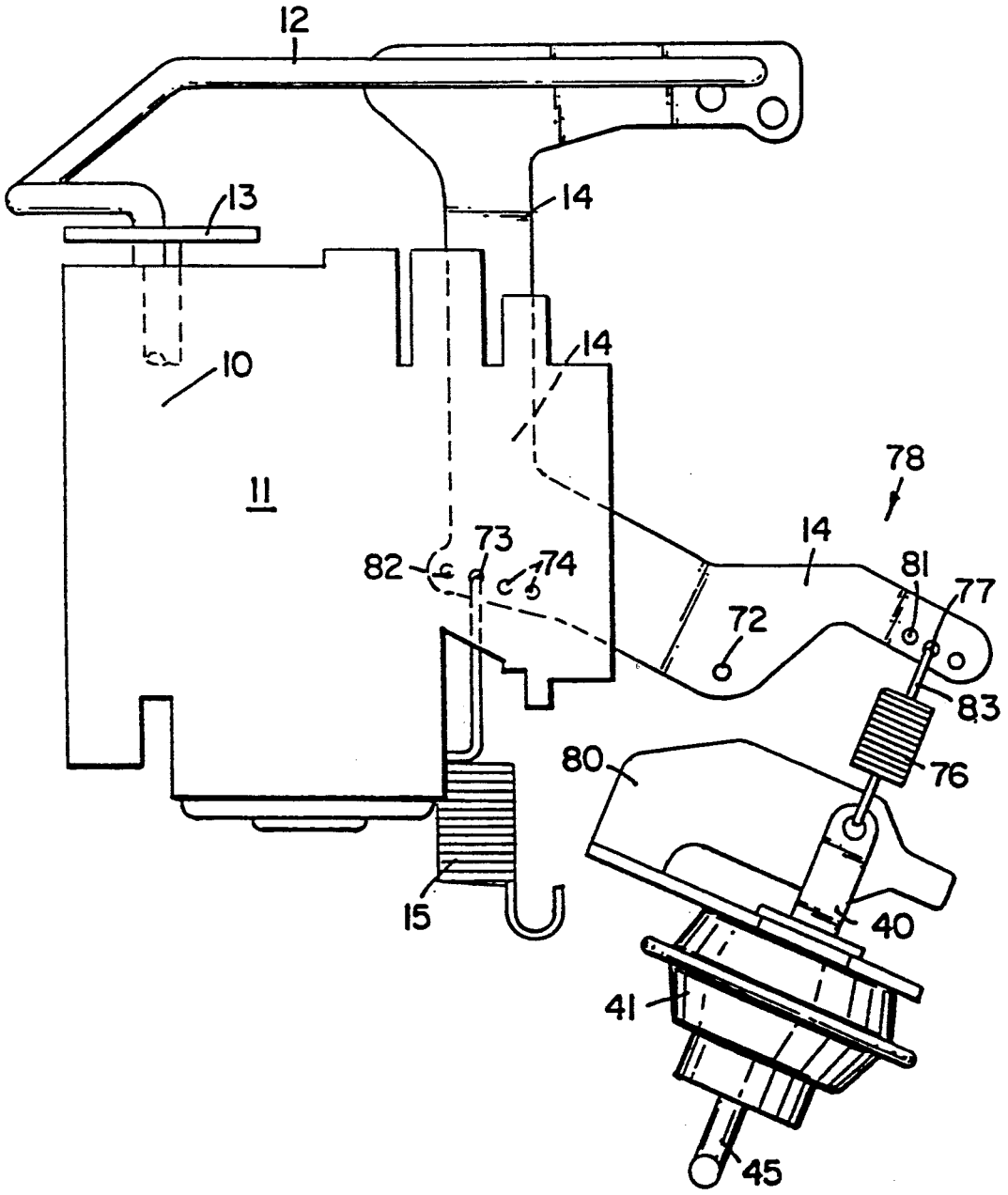
FIG. 9 is a schematic view of the fourth, governor retarding embodiment of the present invention.

The fourth embodiment or governor retarding mechanism is illustrated generally at 78 in FIG. 9. In this embodiment, the components are rearranged so as to operate in the generally reverse direction. Referring to FIG. 9, the opening and closing of the throttle plate 10 is controlled by the throttle lever 13 and control arm 12. The control arm 12 moves to the right and left, as viewed in FIG. 9, according to movement of the primary governor arm 14, which moves about a pivot point 72. The primary governor spring 15 is interconnected to the primary governor arm 14 by means of an adjustable fastening arrangement. In the preferred embodiment, the spring hook 73 is inserted into one of the holes 74 on the primary governor arm 14. The amount of opening of the throttle plate 10 is controlled by which hole 74 the spring hook 75 is attached to, with the left hole 82 resulting in the greatest opening of the throttle plate 10.

The governor retarding mechanism 78 has a secondary assist spring 76 which is interconnected by suitable fastening means 77 to the primary governor arm 14. In the preferred embodiment, the spring hook 83 is interconnected to a particular hole or point 81 along the primary governor arm 14. The position of the holes 81 provides adjustability of the point at which the governor retarding mechanism 78 is activated. The vacuum capsule plunger 40 is operatively connected to the opposite end of the spring 76. A suitable mounting bracket 80 holds the vacuum capsule 41 in the proper position.

As discussed above with the other embodiments, movement of the vacuum capsule plunger 40 is controlled by the pressure in the intake manifold. Specifically, increased vacuum in the intake manifold, which corresponds to low loads, moves the plunger 40 downwardly, as viewed in FIG. 9. This also moves the right end of the primary governor arm 14 in the downward direction about the pivot point 72, which causes movement to the right of the control arm 12, which results in restricting the opening of the throttle plate 10.

The amount of assistance provided by the governor assist mechanism is controlled by the force exerted from the governor boost mechanism on the primary governor system 20. The invention can be varied by changing the spring (i.e., its length or spring constant) to control the initial force and the rate of change of the force.

Even though numerous characteristics and advantages of the invention have been set forth in the foregoing description, together with details of the structure and function of the invention, the disclosure is illustrative only, and changes may be made in detail, especially in matters of shape, size, and arrangement of parts, within the principles of the invention, to the full extent indicated by the broad, general meaning of the appended claims.

We claim:

1. An apparatus for affecting the speed of an engine having an intake manifold, comprising:

(a) a primary governor device having a control arm and a primary governor arm, said control arm having two ends, a first end interconnected to a throttle device and a second end which is directly connected to said primary governor arm at one of several attachment points, said primary governor arm including a pivot point and including a primary governor spring which is attached to said primary governor arm at one of several attachment points;

(b) an assist spring having a first end directly interconnected to the primary governor arm at one of several attachment points, said assist spring having an opposite second end, wherein movement of said assist spring adjusts the position of said primary governor arm and said control arm;

(c) vacuum actuating means operatively interconnected to said second end of said assist spring, including:

(i) a vacuum capsule having a first and second chamber, said first chamber being at atmospheric pressure and said second chamber being in fluid communication with the intake manifold via a conduit so as to have the same pressure as the intake manifold, said first and second chambers being divided by a movable diaphragm; and (ii) a diaphragm plunger interconnected to said diaphragm, one end of said diaphragm plunger being directly interconnected to said assist spring so as to control movement thereof, said assist spring being external to said vacuum capsule, wherein said diaphragm moves automatically in response to the pressure in the intake manifold.

2. The apparatus of claim 1, wherein said assist spring and a primary governor spring are interconnected to said primary governor arm on opposite ends thereof, the primary governor arm having a pivot point between said assist spring and said primary governor spring.

3. The apparatus of claim 1, wherein said first end of said assist spring is interconnected to the primary governor arm at one of a plurality of connection points.

4. The apparatus of claim 2, wherein said first end of said assist spring includes a hook which corresponds to one of a plurality of apertures along said primary governor arm.

5. The apparatus of claim 1, wherein said diaphragm plunger is operatively interconnected to said assist spring by hook means.

6. The apparatus of claim 1, wherein rotation of said primary governor arm about a pivot point causes movement of said control arm, and said primary governor spring and said assist spring are attached to said primary governor arm.

7. The apparatus of claim 6, wherein said primary governor spring and said assist spring are attached to said primary governor arm at attachment points on each side of the pivot point.

8. The apparatus of claim 7, wherein said attachment points are adjustable.

9. A governor assist apparatus, comprising:

(a) a primary governor arm which controls opening and closing of throttle means, said primary governor arm having a first end, an intermediate portion with a pivot point, and a second end, wherein a control arm is directly attached to said primary governor arm at said first end, said control arm being operatively attached to said throttle means;

(b) an assist spring having a first end directly connected to said second end of said primary governor arm, said assist spring having an opposite second end;

(c) vacuum actuating means directly interconnected to said second end of said assist spring, said assist spring being external of said vacuum activating means, including a vacuum capsule having a first and second chamber, said first chamber being at atmospheric pressure and said second chamber being in fluid communication with the intake manifold so as to have the same pressure as the intake manifold, said first and second chambers being divided by a movable diaphragm, wherein said diaphragm moves automatically in response to the pressure in the intake manifold.

10. The apparatus of claim 9, wherein a primary governor spring and said assist spring are attached to said primary governor arm at one of several attachment points along said primary governor arm.

11. The apparatus of claim 10, wherein said attachment points are adjustable.

* * * * *